United States Patent [19]

Rohmann

[11] Patent Number: 5,031,805

[45] Date of Patent: Jul. 16, 1991

[54] PROCESSES AND DEVICE FOR DOSING FREE-FLOWING MEDIA

[75] Inventor: Siegfried Rohmann, Wiesbaden, Fed. Rep. of Germany

[73] Assignee: Westofen GmbH, Wiesbaden, Fed. Rep. of Germany

[21] Appl. No.: 310,832

[22] Filed: Feb. 8, 1989

[30] Foreign Application Priority Data

Feb. 9, 1988 [DE] Fed. Rep. of Germany ..... 3803891

[51] Int. Cl.[5] ..... B22D 39/06

[52] U.S. Cl. ..... 222/590; 222/61; 266/239

[58] Field of Search ..... 266/239, 236, 99; 222/590, 1, 57, 61

[56] References Cited

U.S. PATENT DOCUMENTS 4,220,319 9/1980 Rohmann ..... 266/239
4,638,980 1/1987 Beele ..... 266/239
4,793,596 12/1988 Kabota et al. ..... 266/239

FOREIGN PATENT DOCUMENTS 0077970 6/1980 Japan ..... 266/239

*Primary Examiner*—S. Kastler
*Attorney, Agent, or Firm*—Wenderoth, Lind & Ponack

[57] ABSTRACT

A process and a device for discharging free-flowing media, especially molten metal that is contained in a hermetically sealable vessel having an outlet (2) that has a level-recording unit (3). Pressure is built up in the vessel by supplying a pressurized gaseous medium introduced into the interior of the vessel, whereby the liquid metal is forced from the vessel. After attainment of a certain level of the free-flowing medium in the outlet (2) as detected by the level-recording unit (3), the gaseous medium for building up the dosing pressure is further introduced into the vessel (1) for a predetermined or predeterminable amount of time. Control of pressure inside the vessel (1) is effected by a control unit (4) that receives corresponding signals from a time-recording device (15).

15 Claims, 4 Drawing Sheets

PROCESSES AND DEVICE FOR DOSING FREE-FLOWING MEDIA

BACKGROUND OF THE INVENTION

1. Field of the Invention

The invention relates to processes and a device for dosing free-flowing media, especially molten metal that is contained in a hermetically sealable vessel with an outlet that has a level-recording unit, at which pressure is built up by means of a gaseous medium introduced into the interior of the vessel, through which the free-flowing media is forced from the vessel.

2. Description of the Prior Art

A device of this type is known from DE-PS 20 22 989, in which the pressure needed to deliver molten metal is recorded by several pressure sensors. One drawback of this arrangement is that several pressure-measuring wires must be attached to the hermetically sealable vessel that serves to receive the molten metal, which makes it difficult to insulate the vessel. Moreover, the measured results are distorted. Ultimately, the sensors must be replaced from time to time, which limits the service life of the device.

SUMMARY OF THE INVENTION

It is thus the object of the invention to create a process and device of the type described above in which the number of susceptible components is reduced, through which an accurate dosing of free-flowing media, especially molten metal, is possible independent of the level of molten metal in the vessel.

This object is achieved using a process of the type named above by a procedure whereby the influx of the gaseous medium into the pressurized vessel is maintained for a given time, even if the level-recording unit indicates that a certain level of the free-flowing medium in the outlet of the vessel—namely, that is, the discharge level height—has been attained. The level of the liquid medium in the outlet rises beyond the level determined by the level-recording device as the liquid metal is discharged. Through the further influx of the gaseous medium, the dosing pressure needed for this is built up.

Pressure inside the vessel is thus controlled by controlling the duration of time during which the gaseous medium is introduced into the vessel. The inflow times here are preferably selected dependent on the flow rate of the gas.

This object is also achieved by a process of the type named above that is characterized by the following steps:

Pressure in the vessel is recorded using a pressure sensor; as soon as the free-flowing medium in the outlet has attained a certain level, which is detected by the level-recording unit, the prevailing pressure in the vessel is recorded and stored; pressure in the vessel is increased until the dosing pressure needed for a desired discharge rate is achieved and the output signal from the pressure sensor agrees with a reference signal; the input conduit for the gaseous medium is then interrupted so that the supply of gaseous medium is cut off and pressure in the vessel can remain constant; finally, the vessel is ventilated after the predeterminable dosing time has passed, so that the overpressure in the vessel is reduced. The quantity of liquid metal discharged from the vessel is thus controlled by controlling the pressure inside the vessel. Control over these processes is undertaken and monitored by a control unit.

In addition, this object is achieved by providing a time-recording unit, a control unit for controlling the influx of the gaseous medium flowing into the vessel, and a unit for controlling the pressure of the gaseous medium flowing into the vessel. The advantage of this device is that with a simple design of the device, dosing the free-flowing medium can be carried out very accurately, whereby the time that passes until the free-flowing medium moves from the level during the unpressurized state of the vessel to the given level in the outlet, which is detected by the level-recording unit, increases under the influence of the inflowing gaseous medium.

Moreover, the object is achieved using a device of the type described above that has a pressure sensor for recording the prevailing pressure inside the vessel and a control unit for controlling the influx of the gaseous medium flowing into the vessel. The advantage of this device is that the measured pressure inside the vessel can be used directly as an output signal for controlling the dosing pressure. In this way, the material discharged can be accurately dosed.

BRIEF DESCRIPTION OF THE DRAWINGS

The invention is explained below in further detail with reference to the figures, in which.

DETAILED DESCRIPTION OF THE PREFERRED EMBODIMENTS

Figure 1:
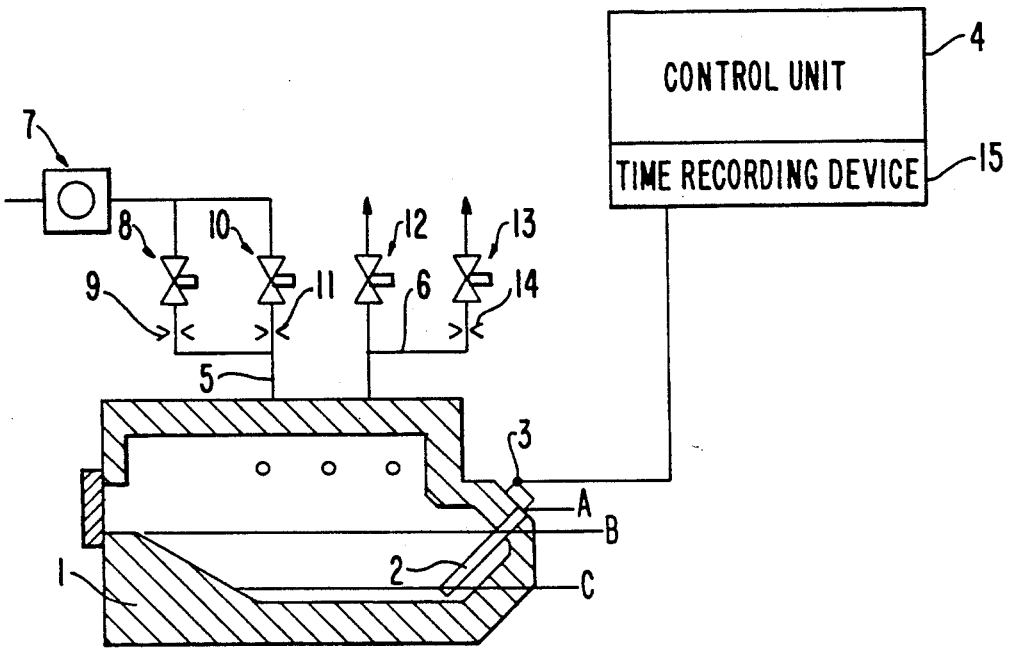
FIG. 1 shows an initial embodiment of a pressurized vessel according to the invention for containing a free-flowing medium.

In FIG. 1, a pressurized vessel for containing a free-flowing medium is schematically depicted. In this case, it is a vessel 1 for containing a liquid metal. The vessel 1 has one outlet 2 that is mounted on the vessel 1 at a suitable angle, preferably at approximately 45°. The outlet 2 basically consists of a heat-resistant pipe, the material of which is chosen so that it does not contaminate the molten mass. The lower end of the pipe is positioned just above the bottom of the vessel.

The upper end of the outlet 2 protrudes from the vessel 1. The discharge aperture is located at the upper end of the outlet. There is a level-recording unit 3 in the area of the discharge aperture, which is linked to a control unit 4.

A compressed air input line 5 and a vent line 6 open through the upper covering of the vessel.

The compressed air supply line 5 is connected to a compressed air source that generates pressure of preferably 6 to 10 bar. The pressure generated by the pressure source is adjusted to the desired level by a pressure regulator 7. Two parallel line segments have a first solenoid valve 8 and a first throttle 9 as well as a second solenoid valve 10 and a second throttle 11. The interior of the vessel is connected, for example, with the ambient air by way of the vent line 6 and a first vent or relief valve 12 as well as by way of a second vent or relief valve 13 in parallel to the first valve 12 and a third throttle 14.

Figure 2:
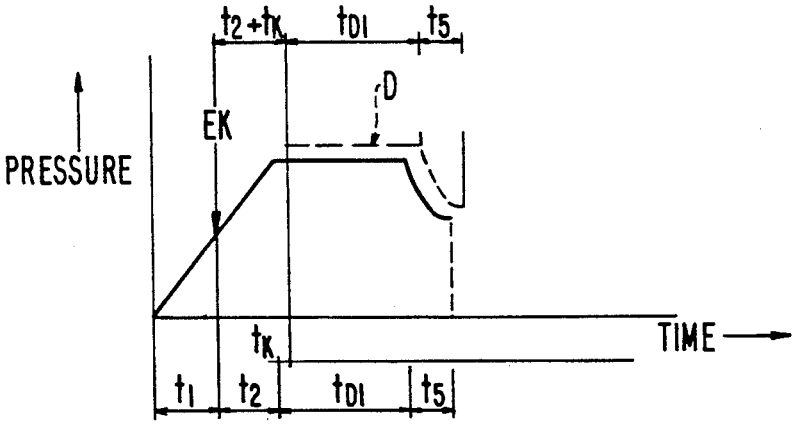
FIG. 2 is a diagram showing the progression of pressure inside the vessel during a simple dosing procedure.
Figure 3:
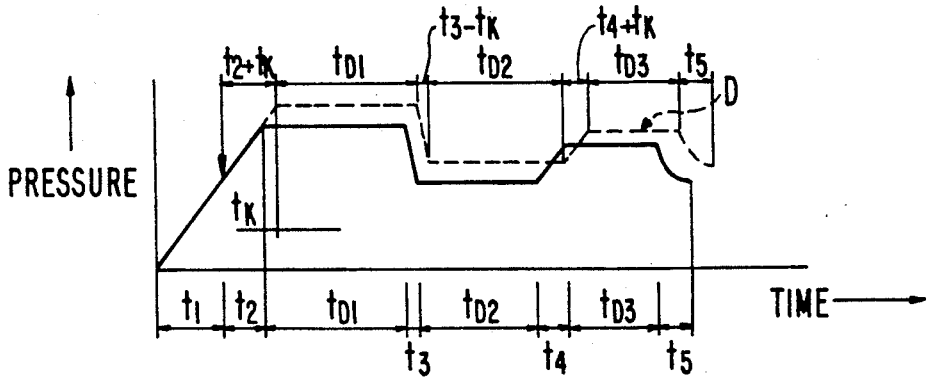
FIG. 3 is a diagram showing the progression of pressure inside the vessel during a dosing procedure with variable dosing pressure.

In FIGS. 2 and 3, the prevailing pressure in the enclosure 1 is depicted over time. The pressure progression P obtained without compensation is depicted by the solid lines, while the pressure progression with compensation of the lowering level in the enclosure 1 is depicted by the broken lines D. Pressure is added to the vessel 1 through the pressure supply line 5 for a time $t_1$ until pressure $P_1$ is reached (the pressure at which the molten metal in outlet 2 is at level A), then the dosing pressure $P_2$ is adjusted by keeping the solenoid valve 8 open for a given period of time $t_2$ after attainment of the discharge level A.

After dosing time $t_{D1}$ is completed, the second vent or relief valve 13 is opened for time $t_3$, so that via the third throttle 14, air can escape from the vessel 1 via the vent line 6. In this way, a lower desired dosing pressure $P_3$ is obtained, and less liquid metal flows from the outlet 2. If, after a given dosing time $t_{D2}$, the discharge rate is to be increased again, the second solenoid valve 10 is opened for time $t_4$ so that additional air reaches the inside of the vessel 1 via the compressed air input line 5 and the second throttle 11. In this way, a further dosing pressure level $P_4$ can be obtained. During this process, the second ventilation valve 13 is kept closed.

Figure 7:
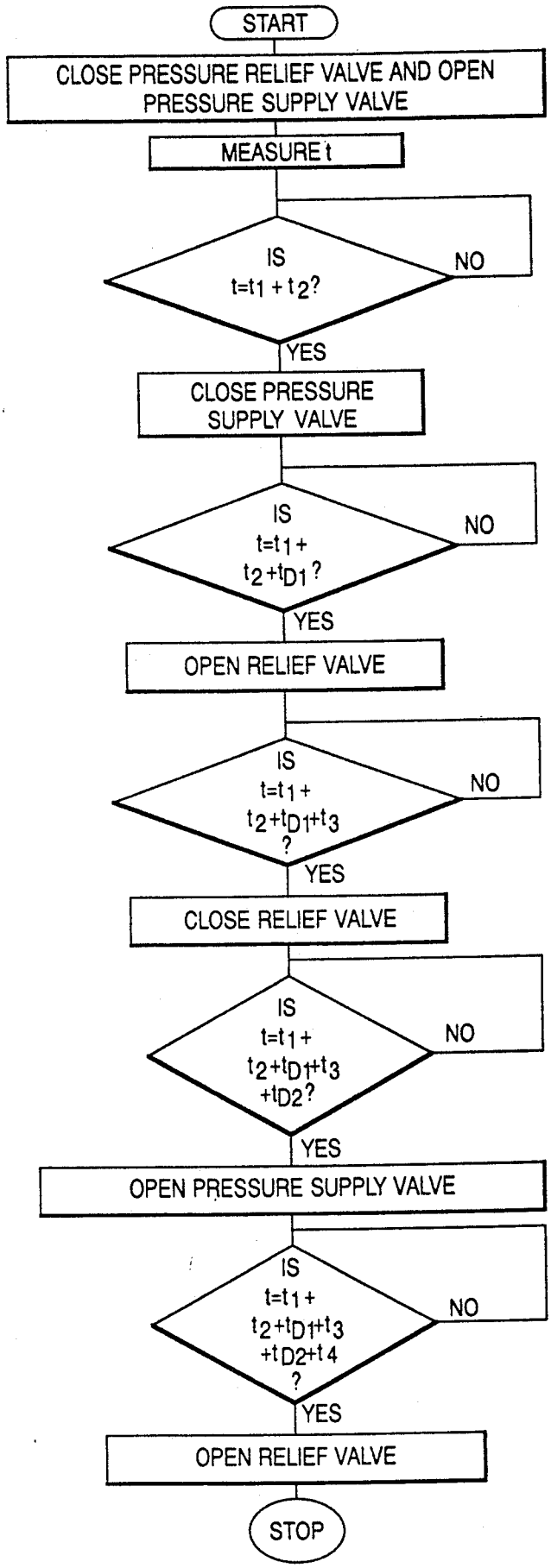
FIG. 7 is a flow chart showing a sequence of steps according to the invention for discharging molten metal upwardly through an outlet tube by controlling time.

The build-up and reduction of pressure can be repeated any number of times. For instance $P_4$ can be maintained for time $t_{D3}$ after which the relief valve 12 can be opened for time $t_5$ to stop the discharge of molten metal through the outlet 2. The foregoing sequence of steps is depicted in the flow chart shown in FIG. 7.

At the completion of casting, the first vent or relief valve 12 is opened, so that the overpressure in the vessel 1 is definitively reduced. The second throttle 11 and the third throttle 14 are preferably adjustable, so that the build-up and reduction of pressure during these processes are adjustable.

In FIG. 3, the broken line D shows that the dosing pressure can be increased with a sinking bath level if the given time during which the first solenoid valve 8 remains open is lengthened by an amount $t_k$ in order to build up the dosing pressure after emission of an output signal by the level-recording unit 3.

Based on the above, it can be seen that exact dosing can be achieved by only controlling the amount of time during which the pressure supply valve(s) and the pressure relief valve(s) are opened and closed.

Figure 5:
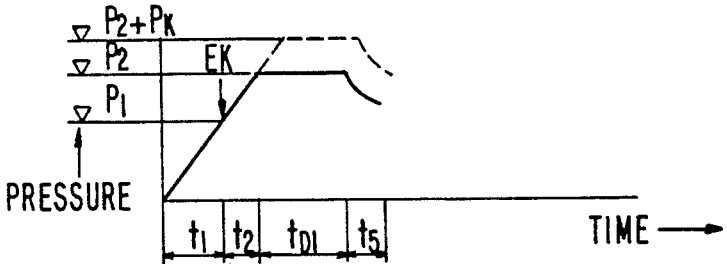
FIG. 5 is a diagram showing the pressure progression during a simple dosing procedure.
Figure 6:
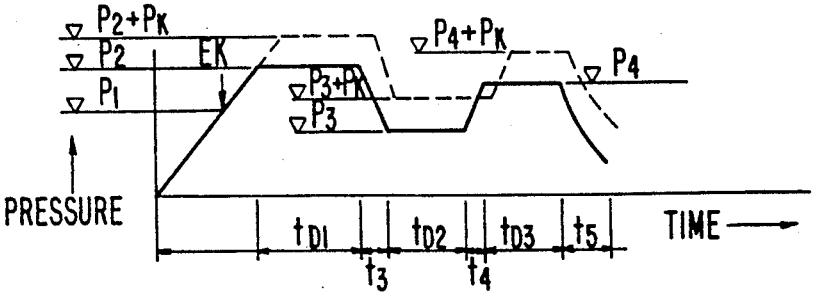
FIG. 6 is a diagram showing the pressure progression during a dosing procedure with variable dosing pressure.

The dosing of a free-flowing medium using a pressure control system will be discussed below. One method of the dosing of liquid metal according to the present invention is shown in FIGS. 4 through 6.

Figure 4:
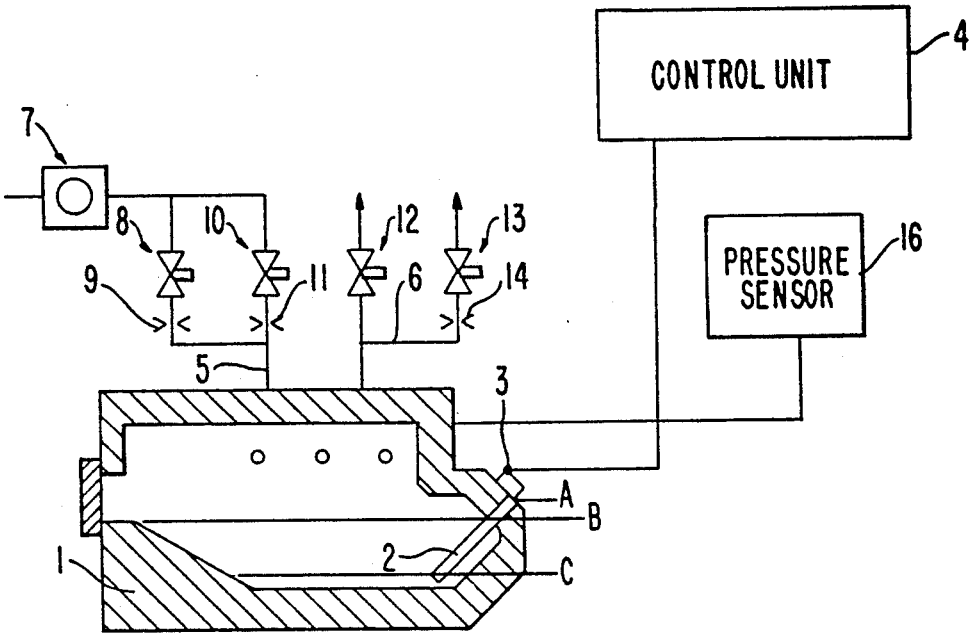
FIG. 4 shows a second embodiment of a pressurized vessel according to the invention for containing a free-flowing medium.

FIG. 4 shows a second embodiment of a furnace with a vessel 1 for liquid, molten metal. Elements that correspond to the device in FIG. 1 are given the same reference symbols and these elements will not be further described in the following explanation.

The level-recording device 3 is again connected to a control unit 4. The time-recording unit 15 (FIG. 1) is not incorporated into this embodiment. Instead, there is a pressure sensor 16, which records the prevailing pressure inside the pressurized vessel 1.

The build-up of pressure and progression of the pressure over time are the same in this embodiment as in the one described above. However, control of the pressure is different.

At the beginning of the dosing process, which can be initiated by a starting signal, for example, the first solenoid valve 8 opens, so that compressed air flows from a compressed air source via the pressure regulator 7 and the first throttle 9 into the inside of the vessel 1. It is assumed that at this point the vessel is filled with liquid metal to its maximum capacity B. It rises in the outlet 2 as far as the discharge level A, so that the level-recording unit 3 emits an output signal, a so-called level signal, to the control unit 4. In addition, the pressure sensor 16 sends a continuous, linear signal to the control unit 4, whereby the signal initially corresponds to a pressure of 0. The output signal of the pressure sensor 16 is stored as soon as the level-recording device emits the level signal.

Effective pressure in the furnace varies, depending on the filling rate of the gas added to the vessel. As noted above, higher gas pressure must be generated in order to move the metal inside the outlet 2 from lower levels to as far as the discharge level A.

Besides the build-up pressure $P_B$ needed to move the metal to the discharge level A, a dosing pressure $P_D$ is required, which varies according to the desired discharge rate of the metal from the vessel 1. The level of measured pressure $P_M$ in the vessel 1 corresponds to a linear signal from the pressure sensor 16. The signals emitted from the pressure sensor 16 during the build-up of pressure and during dosing pressure are added together in order to come up with a variable signal. For example, the control unit 4 records the pressure $P_B$ needed to raise the molten metal to level A and the desired dosing pressure $P_D$ is added to this $P_B$ to arrive at a variable pressure $P_V$ which is compared to the measured pressure $P_M$. Thus, an output signal of the pressure sensor 16 corresponding to $P_M$ is compared with a reference value in the control unit 4 corresponding to $P_V$. If the signal from the pressure sensor 16 agrees with the reference value, the first solenoid valve 8 is closed and the pressure is maintained for a given dosing time $t_D$. After this dosing time is over, the first ventilation valve 12 opens, so that the overpressure in the vessel 1 is reduced and the metal ceases to flow from the outlet.

The dosing pressure needed for a desired discharge rate must be increased slightly from one dosing process to another dosing process, since losses in pressure occur in the hermetically sealed vessel 1 and since the filling level of the vessel decreases during each dosing process. On the other hand, it is not necessary to increase the dosing pressure during a dosing process even though the level of the molten metal decreases since the drop in pressure within the vessel 1 due to the expanded volume of the pressurized gas is small. The pressure needed to raise the level of the metal in the outlet pipe 2 from the maximum filling capacity B to the discharge level A is constant for every type of furnace.

The measured pressure $P_M$ in the vessel 1 must be increased from dosing process to dosing process to compensate for the decreasing bath level. As such, the pressure sensor 16 will output a signal representative of a higher measured pressure $P_M$ to the control unit 4 for every respective output signal from the level recording unit 3 outputted each time the bath level reaches discharge level A. The actual pressure $P_M$ maintained in the vessel 1 following the output signal from the level-recording unit 3 is increased in keeping with the increase necessary to raise the bath level to level A. This takes place by either having (1) a given fraction $P_K$ of the variable build-up pressure $P_B$ added to the build-up pressure $P_B$ and dosing pressure $P_D$ for a given dosing process thus effectively increasing the reference pressure $P_V$ compared to the measured pressure $P_M$ or (2) the fraction $P_K$ deducted from the output signal of the pressure sensor 16 corresponding to the measured pressure $P_M$. Thus, while pressure $P_M$ increases in the vessel 1, until the level in the outlet 2 has reached the discharge level A, the output signal corresponding to the measured pressure $P_M$ of the pressure sensor 16 is reduced on account of this fraction $P_K$. The measured signal from the sensor 16 corresponding to the measured pressure $P_M$ that is compared with the reference signal $P_V$ thus attains the desired given maximum pressure only at an actual pressure which is higher than the predetermined dosing pressure. The magnitude of the deducted signal is adjustable.

Dosing processes with variable dosing pressure will be discussed below. As with time control, a discharge curve with variable pressure might also be necessary for casting permanent molds and sand molds.

In the first phase, actual pressure $P_1$ is built up inside the vessel 1 so that the level cf the liquid medium in the outlet 2 reaches the discharge level A after time $t_1$. The necessary dosing pressure $P_2$ is then built up during time $t_2$. For these processes, there are no differences vis-a-vis the processes described above.

In order to achieve a decrease in the discharge rate, a smaller dosing pressure signal is given after time $t_{D1}$ has passed. In order to reduce the actual pressure inside the vessel to $P_3$, the second vent or relief valve 13 is opened during time $t_3$, so that compressed air can escape from the vessel 1 via the pressure relief line 6, the third throttle 14 and the second vent or relief valve 13. In this way, the actual pressure $P_3$ in the vessel decreases.

After dosing time $t_{D2}$ has passed, during which a lower dosing pressure $P_3$ is desired, an increase in actual pressure up to a pressure $P_4$ is in turn effected. To this end, the second vent or relief valve 13 is reclosed during the time $t_4$, and the second solenoid valve 10 is opened, so that additional compressed air can flow into the vessel 1 via the second throttle 11 and the compressed air input line 5. After the desired dosing pressure $P_4$ is then achieved, it is maintained for a dosing time $t_{D3}$.

Figure 8:
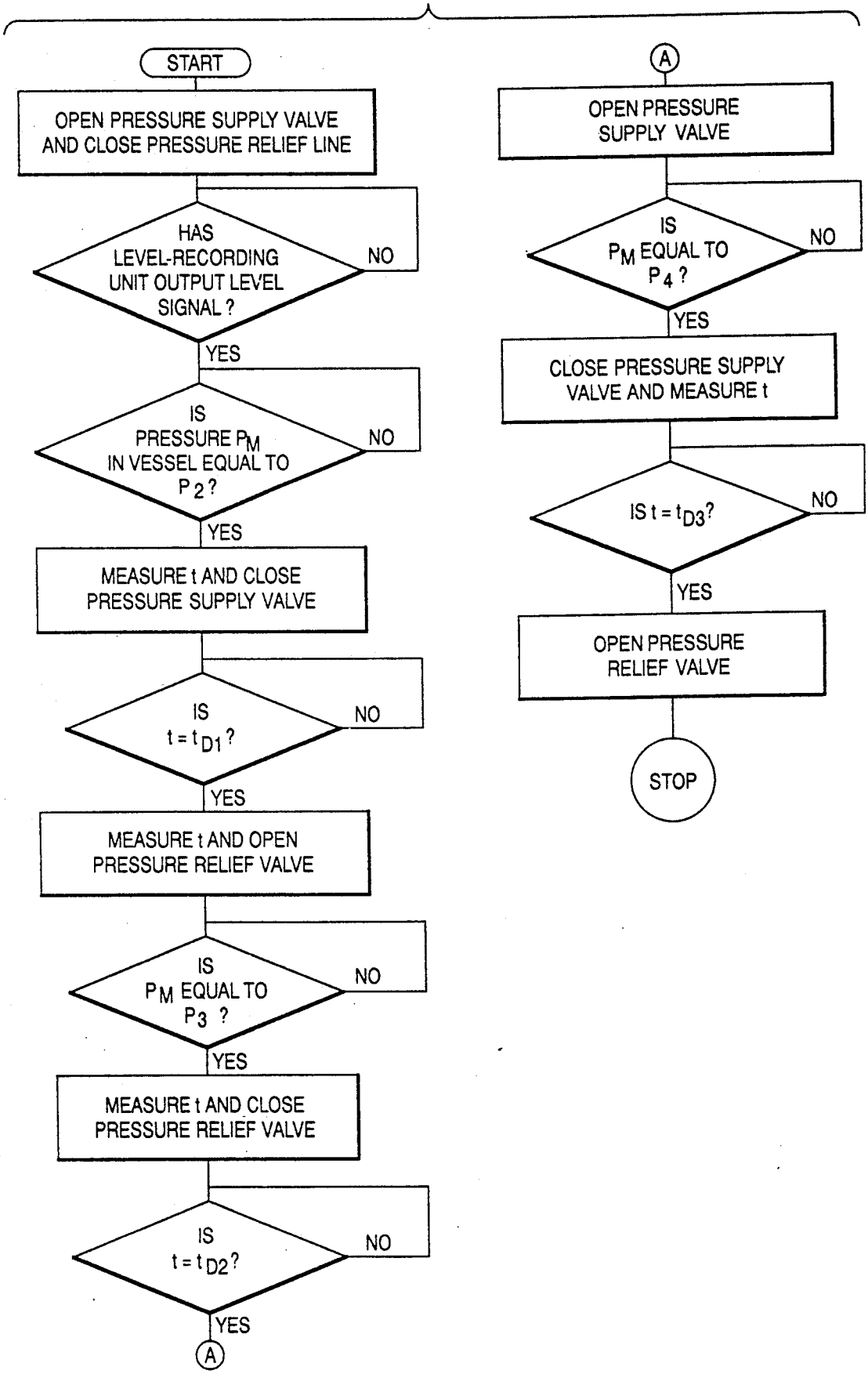
FIG. 8 is a flow chart showing a sequence of steps according to the invention for discharging molten metal upwardly through an outlet tube by controlling the amount of pressure in the vessel acting on the molten metal.

After this dosing time $t_{D3}$ has passed, the first vent or relief valve 12 opens for time $t_5$, so that the furnace or vessel 1 is depressurized and the discharge of metal is terminated. The pressure progression is depicted in FIG. 6 and the foregoing sequence of steps is depicted in the flow chart shown in FIG. 8.

With this variable pressure as well, the decreasing gas filling rate of the vessel 1 can be taken into account during the build-up of pressure, as described above. To this end, a certain fraction of the output signal from the pressure sensor 16, which is emitted to the control unit 4 when the discharge level A is attained, is in turn deducted from the output signal of the pressure sensor 16, so that there is a higher actual dosing pressure in the vessel than the reference dosing pressure being compared in the control unit.

According to what has been said above, dosing liquid metal is also possible in a simple manner with variable dosing pressure, whereby only the pressure conditions prevalent in the vessel 1 of the furnace are used to control the discharge of material.

In both embodiments, the control unit 4 can be designed as a process control system. Moreover, both devices can be combined with a pressure, permanent mold or sand molding device.

While the invention has been described with reference to the foregoing embodiments, many changes and variations may be made thereto which fall within the scope of the appended claims.

What is claimed is:

1. A process for discharging desired dosing amounts of free-flowing media through an outlet of a hermetically sealable vessel by building up gas pressure in the vessel, the vessel including a level-recording unit associated with the outlet for indicating when a level of the free-flowing media in the outlet reaches a discharge level due to gas pressure build-up in the vessel, comprising the steps of:

introducing gas into the vessel for building up gas pressure acting on the free-flowing media to raise the level of the free-flowing media in the outlet;

outputting a level signal from the level-recording unit to a control unit when the level of the free-flowing media in the outlet reaches the discharge level; and after the control unit receives said level signal, introducing additional gas into the vessel for a predetermined amount of build-up time to increase the gas pressure in the vessel to a desired dosing pressure at which the free-flowing media will be discharged at a desired discharge rate.

2. The process of claim 1, further comprising measuring an amount of level-raising time which passes from when gas is initially introduced into the vessel until the level-recording unit outputs the level signal.

3. The process of claim 1, further comprising adjusting the build-up time for increasing the gas pressure to the dosing pressure to compensate for changes in an upper level of the free-flowing media in the vessel, the build-up time being increased if the upper level of the free-flowing media in the vessel drops.

4. The process of claim 3, wherein the step of adjusting the build-up time is performed by measuring an amount of level-raising time which passes from when gas is initially introduced into the vessel until the level-recording unit outputs the level signal, determining a specific fraction of said level-raising time and adding said fraction of level-raising time to the build-up time.

5. The process of claim 1, further comprising measuring an amount of build-up pressure in the vessel when the level-recording unit outputs the level signal and storing said measured build-up pressure in the control unit, measuring an amount of dosing pressure in the vessel during discharge of the free-flowing media from the outlet of the vessel and storing said measured dosing pressure in the control unit, comparing said measured build-up pressure to a predetermined reference build-up pressure stored in the control unit, comparing said measured dosing pressure to a predetermined reference dosing pressure stored in the control unit, and automatically adjusting the dosing pressure by means of the control unit based on the step of comparing said measured build-up pressure to said reference build-up pressure and the step of comparing said measured dosing pressure to said reference dosing pressure.

6. The process of claim 3, wherein the step of adjusting the dosing pressure is performed by measuring an amount of dosing pressure in the vessel during discharge of the free-flowing media from the outlet of the vessel, comparing said measured dosing pressure to a predetermined reference dosing pressure, and adjusting said build-up time based on differences between said measured dosing pressure and said reference dosing pressure.

7. The process of claim 1, wherein the desired discharge rate and amount of the free-flowing media discharged is adjusted by controlling at least one of:

a duration of said build-up time;

an amount of dosing time during which said dosing pressure is maintained during a dosing step;

an amount of time during which said dosing pressure is reduced during a pressure reducing step;

a flow rate at which gas is introduced into the vessel;

a flow rate at which gas is allowed to escape from the vessel;

a desired pressure progression over time at which gas is introduced into the vessel;

reduction of gas pressure in the vessel at a desired pressure progression over time;

at least one of a pressure progression over time and a total volume of free-flowing media discharged from the vessel by using a computer-aided design of a mold to be cast for selection of operations performed by the control unit; and at least one of a pressure progression over time and a total volume of free-flowing media discharged from the vessel by using a computer program for selection of operations performed by the control unit.

8. The process of claim 1, further comprising maintaining the pressure in said vessel at said desired dosing pressure for a predetermined amount of dosing time to provide for a predetermined discharge amount of said free-flowing media.

9. A process for discharging desired dosing amounts of free-flowing media through an outlet of a hermetically sealable vessel by building up gas pressure in the vessel, the vessel including a pressure sensor for measuring gas pressure within the vessel and a level-recording unit associated with the outlet for indicating when a level of the free-flowing media in the outlet reaches a discharge level due to gas pressure build-up in the vessel, comprising the steps of:

measuring prevailing gas pressure within the vessel by means of the pressure sensor and outputting signals to a control unit corresponding to the measured gas pressure;

introducing gas into the vessel for building up gas pressure acting on the free-flowing media to raise the level of the free-flowing media in the outlet;

outputting a level signal from the level-recording unit to the control unit when the level of the free-flowing media in the outlet reaches the discharge level;

recording a build-up gas pressure measured by the pressure sensor in the control unit when the control unit receives the level signal from the level-recording unit;

introducing additional gas into the vessel after the control unit receives the level signal to increase the gas pressure to a desired dosing pressure in the vessel to effect discharge of the free-flowing media at a desired discharge rate, the gas being added until a dosing pressure measured by the pressure sensor corresponds to a first predetermined reference dosing pressure;

interrupting the step of introducing gas into the vessel when said measured dosing pressure corresponds to said first predetermined reference dosing pressure such that said measured dosing pressure remains substantially constant for a first predetermined amount of dosing time to provide for a first predetermined discharge amount of said free-flowing media;

after said first predetermined amount of dosing time has elapsed, reducing said measured pressure in the vessel to a second predetermined reference dosing pressure; and maintaining the pressure in said vessel at said second predetermined dosing pressure for a second predetermined amount of dosing time to provide for a second predetermined discharge amount of said free-flowing media.

10. The process of claim 8, wherein said step of reducing said measured pressure to said second predetermined reference dosing pressure is performed by opening a pressure relief valve means for allowing pressurized gas in the vessel to escape until said measured pressure corresponds to said second predetermined reference dosing pressure.

11. The process of claim 8, further comprising a step of automatically deriving said first predetermined reference dosing pressure by means of the control unit based on said measured build-up pressure and said measured dosing pressure.

12. The process of claim 10, wherein said step of deriving said first predetermined reference dosing pressure further comprises a step of adjusting said first predetermined reference dosing pressure to compensate for changes in an upper level of the free-flowing media in the vessel such that said first predetermined reference dosing pressure is increased if the upper level of the free-flowing media in the vessel drops, said adjusting step being performed by converting the respective signals outputted from the pressure sensor to a compensation signal which is compared to said first predetermined reference dosing pressure for purposes of adjusting the prevailing pressure in the vessel to compensate for changes in the upper level of the free-flowing media in the vessel such as when the upper level drops from one dosing process during which said first predetermined amount of free-flowing media is discharged from the vessel to a following dosing process during which said second predetermined amount of free-flowing media is discharged from the vessel.

13. The process of claim 11, wherein said compensation signal corresponds to a fraction of the measured dosing pressure during a preceding dosing process.

14. The process of claim 8, wherein the discharge rate at which the free-flowing media is discharged from the vessel is controlled by at least one of:

adjusting the prevailing pressure in the vessel;

introducing the gas at an adjustable flow rate;

introducing the gas at a desired pressure progression over time which is achieved by controlling the gas flow rate into the vessel;

at least one of a pressure progression over time and a total volume of free-flowing media discharged from the vessel by means of the control unit using a computer-aided design of a mold to be cast; and at least one of a pressure progression over time and a total volume of free-flowing media discharged from the vessel by means of the control unit using a computer program.

15. The process of claim 9, wherein said step of reducing said measured pressure in the vessel is performed by reducing gas pressure in the vessel at a desired pressure progression over time by controlling an adjustable flow rate of gas escaping from the vessel through said pressure relief valve means.

* * * * *